US007168995B2

(12) United States Patent
Masui et al.

(10) Patent No.: US 7,168,995 B2
(45) Date of Patent: Jan. 30, 2007

(54) PROPULSION UNIT FOR BOAT

(75) Inventors: Hideaki Masui, Shizuoka-ken (JP); Chitoshi Saito, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/103,402

(22) Filed: Apr. 11, 2005

(65) Prior Publication Data

US 2005/0272320 A1 Dec. 8, 2005

(30) Foreign Application Priority Data

Apr. 20, 2004 (JP) ..... 2004-115936

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 6,102,755 A * 8/2000 Hoshiba ..... 440/1
2003/0013354 A1* 1/2003 Yanagihara ..... 440/1
2004/0121661 A1* 6/2004 Okuyama ..... 440/1

FOREIGN PATENT DOCUMENTS

JP 2001-152895 6/2001

* cited by examiner

*Primary Examiner*—Stephen Avila
(74) *Attorney, Agent, or Firm*—Knobbe, Martens, Olson & Bear, LLP

(57) ABSTRACT

A propulsion unit can comprise a propeller and an internal combustion engine for driving the propeller. The propulsion unit can include a gear switching device for changing a drive mode of the propulsion unit between a forward drive mode, a reverse drive mode and a neutral mode. A throttle valve can be configured to control an opening of a first intake passage of the engine, and an idle speed control valve can be configured to control an opening of a second intake passage downstream of the first intake passage can also be provided. The propulsion unit can also comprise a control unit for controlling the idle speed control valve, wherein the control unit is configured to bring the engine to a first target rotational speed when the propeller is in the neutral mode, and to a second target rotational speed when the propeller is in the forward or reverse drive mode, wherein the first rotational speed is greater than the second rotational speed.

10 Claims, 2 Drawing Sheets

PROPULSION UNIT FOR BOAT

PRIORITY INFORMATION

This application is based on and claims priority under 35 U.S.C. §119 to Japanese Patent Application No. 2004-115936, filed on Apr. 9, 2004, the entire contents of which is hereby expressly incorporated by reference herein.

BACKGROUND OF THE INVENTIONS

1. Field of the Inventions

The present inventions relate generally to a propulsion unit for a boat, and, more particularly, to controlling an idle speed control ("ISC") valve of an engine of a boat.

2. Background of the Invention

Many different propulsion units, such as outboard motors, may be used to propel a boat. One such outboard motor is shown in Japanese Patent Application No. JP 2001-152895. In this application, the propulsion unit is supported by the boat's hull and includes a propeller. An internal combustion engine is also supported by the hull for driving the propeller of the propulsion unit.

The boat also includes a gear switching device that can change the state of the drive gears coupling the internal combustion engine and the propeller. Typically, these types of gear change transmissions allow an operator to switch between a forward drive mode, a reverse drive mode, and a neutral mode.

As is typical in the internal combustion engine art, a throttle valve controls the air flow through an intake passage that guides air from the atmosphere to the internal combustion engine. A secondary valve, also known as an idle speed control valve ("ISC valve"), controls the air flow through a secondary air passage configured to guide air from the atmosphere to the intake passage at a point downstream of the throttle valve. Finally, a control unit may be provided for controlling the idle speed of the engine by adjusting the position of the ISC valve. The system disclosed in JP 2001-152895 is configured to bring the internal combustion engine to a predetermined rotational speed when the throttle valve is closed quickly.

During operation of such a boat, with the internal combustion engine running, the switching device is shifted to the desired drive position so as to transmit power from the engine to the propeller. The throttle valve may also be controlled to adjust the opening of the intake passage, so that a desired amount of air can be introduced into the internal combustion engine. The amount of air introduced is generally proportional to the power produced by the engine. Thus, the operator can control both the direction and speed of the boat.

When the boat is cruising at a cruising speed and the throttle valve is closed quickly to decelerate the boat, the internal combustion engine is also rapidly decelerated, and the amount of intake air needed is decreased. However, in this typical deceleration scenario, the amount of intake air being supplied to the internal combustion engine may still be insufficient, even for the engine's reduced needs, and the engine can stall.

As discussed in the above referenced Japanese application, the control unit for the ISC valve preferably automatically opens the secondary air passage to bring the internal combustion engine to a target rotational speed. This secondary air prevents the internal combustion engine from stalling regardless of how quickly the throttle valve is closed. The internal combustion engine can thereby maintain a predetermined target rotational speed.

SUMMARY OF THE INVENTION

An aspect of at least one of the embodiments disclosed herein includes the realization that there are other modes of operation that can benefit from further manipulation of an idle speed control valve for reducing the likelihood of stalling. For example, as is well known in the art, in order to decelerate or drive the boat backwards after it has been moving forward, the following steps must be performed by an operator: First, the throttle valve must be closed quickly to decelerate the internal combustion engine as described above. Second, the switching device that controls the direction of the propeller is used to change the coupling between the engine and the propeller from a forward drive mode to a neutral mode. Third, the switching device may be used to change the coupling to a reverse drive mode. The throttle valve can then be re-opened to generate additional reverse thrust.

As the engine is rapidly decelerated in the first step, the control unit of the prior art preferably opens the ISC valve in order to prevent the engine from stalling. As the engine is brought to the neutral mode, the load on the engine is rapidly decreased. Thus, the engine quickly reaches the target rotational speed that the control unit seeks to achieve, and the control unit opens the ISC valve only slightly.

In the third step, when the boat is shifted into the reverse drive mode, the inertia of the boat generated by its previous, forward motion applies a load to the propeller opposing the reverse rotation of the propeller. Therefore, when the propeller is shifted to this reverse drive mode, a load is applied to the internal combustion engine. Since the ISC valve is opened only slightly in the neutral mode, only a small amount of secondary air is being supplied to the engine. Therefore, as the engine is shifted into reverse, an insufficient amount of air reaches the engine in order to overcome the load, and the engine might stall.

Thus, in accordance with one embodiment, a propulsion unit for a boat comprises a propeller and an internal combustion engine configured to drive the propeller. A gear change device is configured to couple the engine and the propeller in at least one of a forward drive mode, a reverse drive mode and a neutral mode. A throttle valve is configured to control an opening of a first intake passage of the engine. An idle speed control valve is configured to control an opening of a second intake passage downstream of the first intake passage. Additionally, a control unit is configured to control the idle speed control valve. The control unit is configured to bring the engine to a first target rotational speed when the propeller is in the neutral mode, and to a second target rotational speed when the propeller is in the forward or reverse drive mode, wherein the first rotational speed is greater than the second rotational speed.

According to another embodiment, a control unit is configured to regulate an idle speed of a boat engine. The control unit comprises a processor electronically coupled to a throttle opening sensor. The processor is programmed to increase a target rotational idle speed of the engine to a first predetermined rotational speed when the engine is shifted to neutral and when the throttle opening sensor indicates that a throttle opening has been closed rapidly.

According to yet another embodiment, a method for controlling a boat engine is disclosed. The method includes determining whether a throttle valve of the boat engine is closed gradually or rapidly. The method can also include detecting when a transmission of the boat is shifted to a neutral mode from a forward drive mode. Additionally, the method can include increasing a target idle speed of the engine in the neutral mode relative to a target idle speed of the engine in the forward drive mode if the throttle valve is closed quickly.

DETAILED DESCRIPTION OF THE PREFERRED EMBODIMENT

Figure 1:
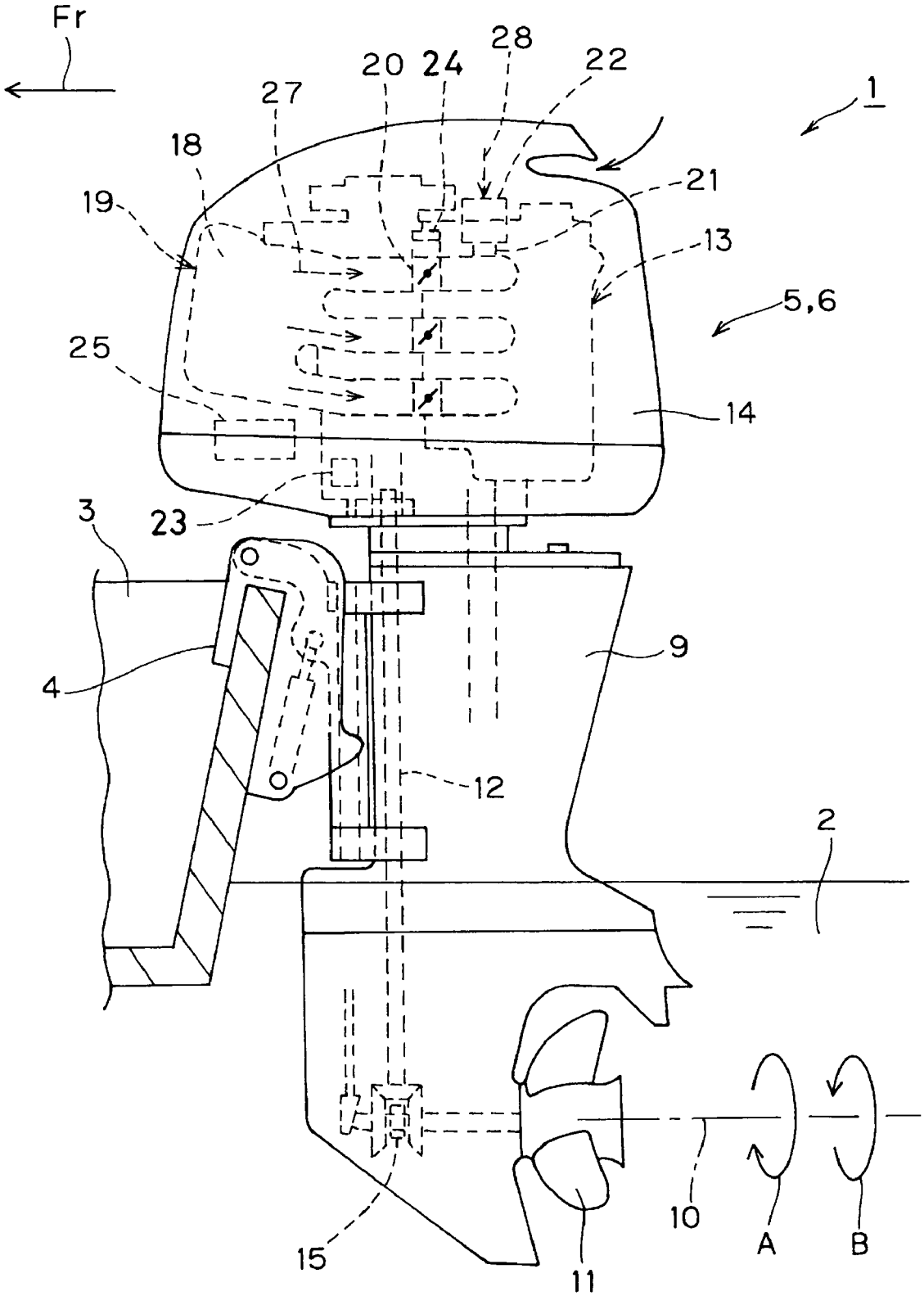
FIG. 1 is a side, schematic view of a rear portion of a boat according to an embodiment.

FIG. 1 illustrates a small boat 1 with a propulsion unit 6 to which the present embodiments are applicable. The embodiments disclosed herein are described in the context of a marine propulsion unit of a small boat because these embodiments have particular utility in this context. However, the embodiments and inventions herein can also be applied to other marine vessels as well as other vehicles.

With continued reference to FIG. 1, the boat 1 (partially illustrated) includes a hull 3 designed to float on the surface of water 2. The propulsion unit 6, which in some embodiments can be an outboard motor 5, is supported on the rear end of the hull 3 by a clamp bracket 4. The arrow Fr indicates the forward direction in which the boat 1 can travel. Of course, in other embodiments, other propulsion units can be used to propel the boat, such as, for example, but without limitation, jet-propulsion units, inboard and inboard/outboard type units.

In the illustrated embodiment, the outboard motor 5 has a vertically elongated case 9. The case 9 includes an upper part rotatably supported by the clamp bracket 4, and a lower part located under the surface of the water 2. The outboard motor 5 has at its lower end a propeller 11, which rotates about an axis 10 extending in the longitudinal direction of the hull 3.

An internal combustion engine 13 is preferably supported by the case 9 and drives the propeller 11 via a drive shaft 12. The drive shaft 12 drives the propeller 11 through a gear change transmission. A cowling 14 can also be provided to cover the internal combustion engine 13. The cowling 14 is preferably removably supported on top of the case 9, and can easily be disconnected to provide access to the engine 13.

In a preferred embodiment, a gear change device 15 (also referred to as a "gear change transmission") is configured to change a mode of operation of the coupling between the drive shaft 12 and the propeller 11. The switching device 15 can be configured to allow an operator to drive the propeller 11 in either a forward drive mode A or a reverse drive mode B, and to provide a neutral mode N in which the propeller is not driven by the drive shaft 12.

The switching device 15 can be considered as forming one part of the transmission, as is familiar to those of skill in the art. In some embodiments, the engine 13 need not be provided with a drive shaft 12, but can include a switching device for changing between forward, neutral, and reverse drive modes that otherwise connects the engine and a propulsion device such as a propeller or impeller.

With continued reference to FIG. 1, the outboard motor 5 can include an intake manifold 19 connected to the air intake section (e.g., intake ports) of the internal combustion engine 13. The intake manifold 19 can include intake passages 18 configured to communicate with the atmosphere, and which extend toward the combustion chambers (not shown) of the engine 13.

Throttle valves 20 can be provided for controlling the opening or the flow of air through the intake passages 18. An idle speed control valve, such as the ISC valve 22, can be used to control the opening or the flow of air through secondary air passages 21 which communicate with the intake passages 18 downstream of the throttle valves 20.

The ISC valve 22 can be supported by the intake manifold 19, as is well known to those of skill in the art. In other embodiments, multiple ISC valves 22 can be simultaneously used to control the flow of air through the secondary air passages 21.

In some embodiments, one or more sensors, such as a crank angle detection sensor 23, can be used to detect the crank angle of the crankshaft and/or the rotational speed of the internal combustion engine 13. A throttle opening sensor 24 can also be used for detecting the throttle opening of the throttle valves 20.

With continued reference to FIG. 1, the outboard motor 5 can further be provided with an electronic control unit 25 to which the ISC valve 22, the crank angle detection sensor 23, the throttle opening sensor 24, and/or other sensors can be electronically connected. The control unit 25 preferably receives detection signals from the two sensors 23, 24, and performs feedback control (or "dashpot control") of the ISC valve 22. Thus, the control unit 25 electronically controls the ISC valve so that the internal combustion engine 13 can be rotated at a predetermined, target rotational speeds. In a typical implementation, the control unit 25 comprises at least one processor (not shown) that receives inputs from the sensors 23, 24, and which sends a corresponding output to an ISC valve controller.

In some embodiments, when the throttle valves 20 are opened or closed, a detection signal indicating the throttle opening of the throttle valves 20 is sent to the control unit 25 from the throttle opening sensor 24. A detection signal indicating the rotational speed of the engine 13 is also sent to the control unit 25 by the crank angle detection sensor 23. If the throttle valves 20 are opened or closed normally, and the boat is in a normal driving state, the ISC valve 22 is controlled by the control unit 25, which is programmed to ensure that the engine 13 runs at a predetermined, target rotational speed R0 or higher. This rotational speed R0 is preferably set to a value that is lower than the rotational speed at which the engine 13 will rotate if the throttle valves 20 are operated normally. In other wards, the speed R0 can be in an idle-speed range. Thus, when the throttle valves 20 are opened or closed normally, the ISC valve 22 remains closed.

In some embodiments, when the throttle valves 20 are closed quickly, the control unit 25 opens the ISC valve 22 to achieve different predetermined engine rotational speeds depending upon which drive mode the engine and propeller are set to. For example, when the propeller 11 is in either a forward drive mode A or a reverse drive mode B, the ISC valve 22 will be opened sufficiently to bring the engine 13 to a first rotational speed, R1. If the propeller 11 is set to a neutral mode N, the ISC valve 22 will be opened to bring the engine to a second target rotational speed R2. In some embodiments, the second target rotational speed R2 is set to a value that is higher than the first target rotational speed R1.

The control unit 25 is preferably programmed to release control of the ISC valve 22 after a predetermined period of time T. Thus, after the throttle valves 20 have been closed abnormally quickly, the ISC valve 22 will only be controlled for the time T. In some embodiments, the time T can be about 10 seconds. As would be well understood by those of skill in the art, different times can be used depending on the boat design (including its shape and aerodynamic characteristics), and the time it takes those different boats and engines to slow down.

The operation of the above described boat 1 and control unit 25 is described in greater detail with reference to FIG. 2. In the first time period a-b of FIG. 2, the internal combustion engine 13 drives the boat 1 in a forward direction, with the throttle valves 20 opened and with the boat in a forward drive mode A. Thus, via the throttle valves 20 and switching device 15, the engine 13 is operated to drive the boat in a desired forward direction at a desired speed.

Figure 2:
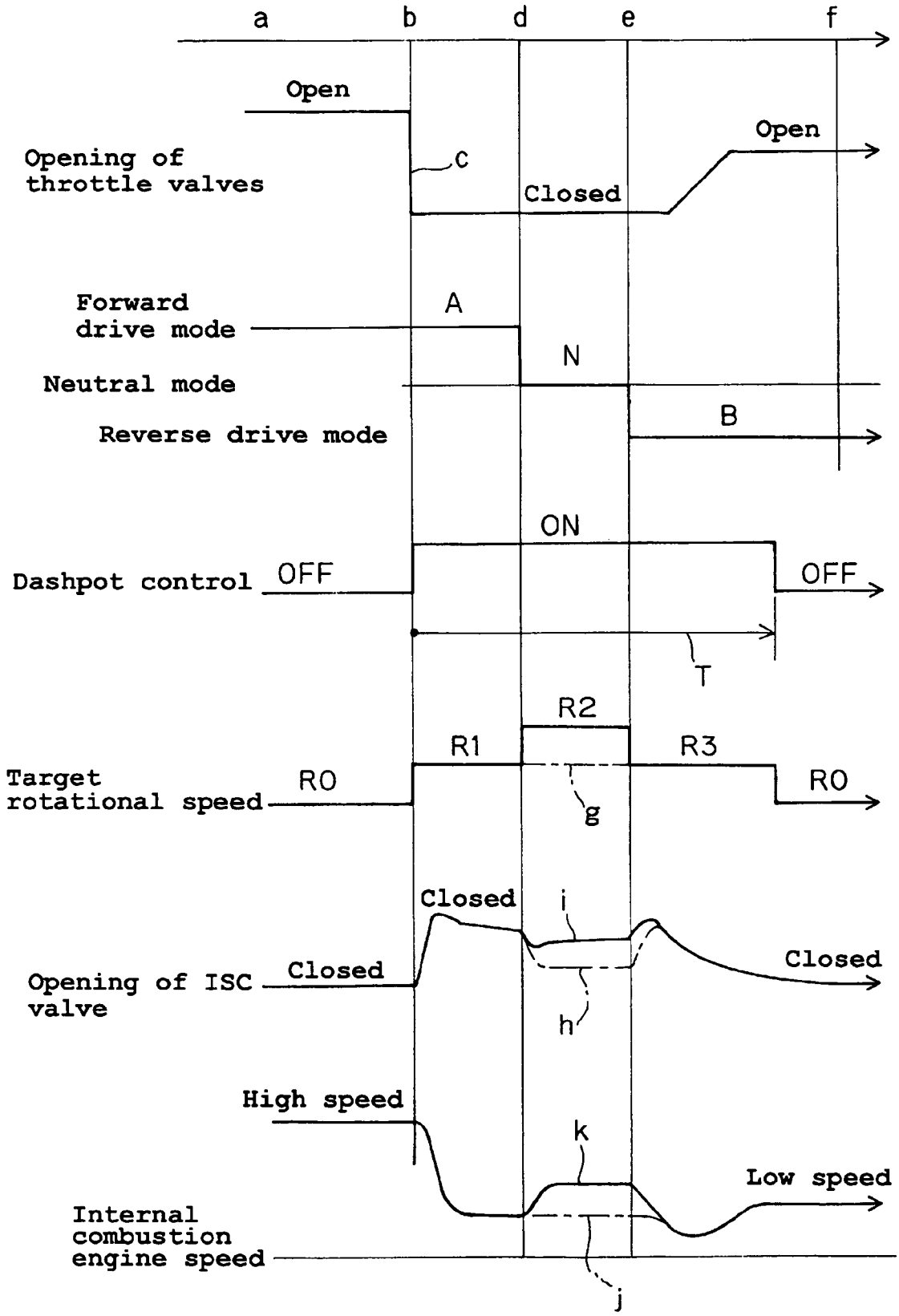
FIG. 2 is a time chart illustrating a control method that can be used with an ISC control unit of the boat of FIG. 1.

At the moment represented by the letter c in FIG. 2, the boat's operator closes the throttle valves 20 of the boat 1 quickly, in order to rapidly decelerate the boat 1. Prior to this moment, the boat 1 had been accelerated to an elevated speed during the time period a-b. As the throttle valves 20 are closed quickly, the internal combustion engine 13 is also decelerated quickly, and the amount of intake air 27 necessary to drive the engine 13 is decreased.

The amount of intake air 27 being supplied to the engine 13 through the intake passages 18 may be insufficient as a result of the rapid closing of the throttle valves 20. Thus, as illustrated in FIG. 2, the control unit 25 can then open the ISC valve 22 in order to supply more air to the internal combustion engine 13, bringing it to at least the first target rotational speed R1. This action takes place during the time period represented as b-d in FIG. 2.

The control unit 25 preferably operates the ISC valve 22 in order to supply secondary air 28 from the atmosphere to the internal combustion engine 13. Thus, even if the throttle valves 20 are closed quickly, a sufficient supply of intake air is provided to the engine 13. The internal combustion engine 13 thereby maintains a first target rotational speed, R1, and is prevented from stalling.

If the operator wishes to propel the boat 1 backwards, the operator can then operate the switching device 15 to change the coupling between the internal combustion engine 13 and the propeller 11 from the forward drive mode A to the neutral mode N. This operation is shown in the time period d-e in FIG. 2. This intermediate coupling step is followed quickly by a third step, in which the operator changes the coupling from the neutral mode N to the reverse drive mode B, as shown in e-f of FIG. 2.

When the coupling between the engine 13 and the propeller 11 is changed from the forward drive mode A to the neutral mode N in the second step, the load on the internal combustion engine 13 is decreased rapidly because the engine 13 is no longer driving the propeller 11. The control unit 25 can then open the ISC valve 22 to a relatively large extent (identified as "i" in FIG. 2), and a large amount of secondary air 28 can be supplied to the internal combustion engine 13. Thus, the engine 13 is brought to a higher rotational speed R2. In some embodiments, the speed R2 can be at least 500 rpm greater than R1. If the target rotational speed (shown as g in FIG. 2) had remained lower in the neutral mode N, then the engine speed and ISC valve opening, identified as j and h respectively in FIG. 2, would have been correspondingly lower, and the engine would have been more likely to stall.

When the coupling is changed to the reverse drive mode B, shown in the time period e-f of FIG. 2, the boat 1 is still moving forward as a result of its momentum. Thus, as discussed above, the water 2 applies a load to the propeller 11 opposing the rotation of the propeller 11 in the reverse drive mode B. When the propeller 11 is shifted to the reverse drive mode B in the third step, a load is therefore applied to the engine 13 from the propeller 11.

According to one embodiment of the invention, a large amount of air was supplied to the internal combustion engine 13 once the coupling was changed to the neutral mode N in the second step, as described above. Thus, during the time period d-e, the engine 13 is rotated at the higher rotational speed R2. Even if a large load is applied to the internal combustion engine 13 as the coupling changes to a reverse drive mode B, the engine 13 can keep operating against this new load and thus is less likely to stall.

Since the load on the engine 13 is decreased rapidly when the mode is changed into the neutral mode N, the internal combustion engine 13 can quickly reach the second target rotational speed R2. Thus, while the propeller 11 is in the neutral mode N, the control unit 25 rapidly opens the ISC valve 22 in order to control the internal combustion engine 13. A large amount of secondary air 28 is then supplied to the engine 13. Even if a large load is later applied to the internal combustion engine 13 when the propeller 11 is shifted to the reverse drive mode B, the internal combustion engine 13 can resist the load from the propeller 11 and is less likely to stall.

The control unit 25 preferably relinquishes control of the ISC valve 22 after a predetermined period of time T has elapsed. In general, if the propeller 11 has been kept in the neutral mode N for a long period of time, the forward momentum of the boat 1 will be greatly diminished. In this state, the water 2 does not apply a large load to the propeller 11 opposing the rotation of the propeller 11 in the reverse drive mode B. Thus, when the mode is changed to the reverse drive mode B, a large load will not be applied to the internal combustion engine 13 from the propeller 11, and the ISC valve 22 need not be opened.

In some embodiments, the control unit 25 ceases controlling the ISC valve 22 after a predetermined period of time T, which can be dependent on the period of time during which the boat 1 continues to move forward as a result of its inertia. In addition, according to this preferred embodiment, the ISC valve 22 does not remain open for an excessively long period of time, and an unnecessarily large amount of secondary air 28 is not supplied to the engine 13. Thus, the internal combustion engine 13 is not rotated at a high speed for a long time.

Of course, in other embodiments, many of the details discussed above can differ in ways well known to those of skill in the art. For example, the propulsion unit 6 need not be an outboard motor 5. The internal combustion engine 13 can be housed in the hull 3, or the propeller, the drive shaft 12, and the internal combustion engine 13 can be supported within the hull 3. The rotational speed of the internal combustion engine 13 can also be detected based on pulse signals from a pulse coil of an ignition unit.

According to another embodiment, a speed sensor can be used to detect the speed of the boat 1 traveling through the water. Using this information, the control unit 25, which can be electronically coupled to the speed sensor, can calibrate the ISC valve opening based upon the relative speed of the boat 1, since this relative speed will track the load placed upon the propeller 11 opposing its rotation. In some embodiments, for example, the control unit 25 can be configured to only maintain the engine speed at R2 or greater if the relative boat speed is above a predetermined value. Additionally, in some embodiments, the control unit 25 can be configured to bring the engine to differing speeds in neutral depending upon the relative boat speed. For example, the control unit can have a table saved in a memory of the control unit 25 by which it can determine an appropriate rotational speed for the engine 13 at different boat speeds.

What is claimed is:

1. A propulsion unit for a boat, comprising a propeller, an internal combustion engine configured to drive the propeller, a gear change device configured to couple the engine and the propeller in at least one of a forward drive mode, a reverse drive mode and a neutral mode, a throttle valve configured to control an opening of a first intake passage of the engine, an idle speed control valve configured to control an opening of a second intake passage downstream of the first intake passage, and a control unit configured to control the idle speed control valve, wherein the control unit is configured to bring the engine to a first target rotational speed when the propeller is in the neutral mode, and to a second target rotational speed when the propeller is in the forward or reverse drive mode, wherein the first rotational speed is greater than the second rotational speed.

2. The propulsion unit of claim 1, wherein the control unit is further configured to determine if the throttle valve is closed quickly or gradually and to adjust idle speed control valve differently based on whether the throttle valve is closed gradually or quickly.

3. The propulsion unit of claim 2, wherein the control unit is configured to close the idle speed control valve after a predetermined period of time elapses after the throttle valve is closed quickly.

4. The propulsion unit of claim 3, wherein the predetermined period of time is determined based on a shape and aerodynamic characteristics of the boat.

5. The propulsion unit of claim 3, wherein the predetermined period of time is approximately 10 seconds.

6. The propulsion unit of claim 1, wherein the control unit is electronically coupled to a crank angle detection sensor and a throttle opening sensor.

7. The propulsion unit of claim 1, wherein the first rotational speed differs from the second rotational speed by at least about 500 rpm.

8. A control unit configured to regulate an idle speed of a boat engine, the control unit comprising a processor electronically coupled to a throttle opening sensor, wherein the processor is programmed to increase a target rotational idle speed of the engine to a first predetermined rotational speed when the engine is shifted to neutral and when the throttle opening sensor indicates that a throttle opening has been closed rapidly, wherein the processor is electronically coupled to an idle speed control valve for controlling the idle speed.

9. The control unit of claim 8, wherein the processor is further programmed to bring the target rotational idle speed of the engine to a second predetermined rotational speed when the engine is shifted to a forward drive mode or a reverse drive mode, wherein the second rotational speed is lower than the first rotational speed.

10. A method for controlling a boat engine, the method comprising:

determining whether a throttle valve of the boat engine is closed gradually or rapidly;

detecting when a transmission of the boat is shifted to a neutral mode from a forward drive mode; and adjusting an idle speed control valve to thereby increase a target idle speed of the engine in the neutral mode relative to a target idle speed of the engine in the forward drive mode if the throttle valve is closed quickly.

* * * * *

UNITED STATES PATENT AND TRADEMARK OFFICE

CERTIFICATE OF CORRECTION

PATENT NO. : 7,168,995 B2
APPLICATION NO. : 11/103402
DATED : January 30, 2007
INVENTOR(S) : Hideaki Masui et al.

It is certified that error appears in the above-identified patent and that said Letters Patent is hereby corrected as shown below:

Title Page in (30) Foreign Application Priority Data, please delete "April 20, 2004" and add --April 9, 2004--.

Signed and Sealed this

Twenty-seventh Day of November, 2007

JON W. DUDAS
*Director of the United States Patent and Trademark Office*